United States Patent [19]

Kuroiwa et al.

[11] Patent Number: 4,552,116

[45] Date of Patent: Nov. 12, 1985

[54] ENGINE CONTROL APPARATUS

[75] Inventors: Hiroshi Kuroiwa, Hitachi; Tadashi Kirisawa, Katsuta; Teruo Yamauchi, Katsuta; Yoshishige Oyama, Katsuta, all of Japan

[73] Assignee: Hitachi, Ltd., Tokyo, Japan

[21] Appl. No.: 641,337

[22] Filed: Aug. 16, 1984

[30] Foreign Application Priority Data

Aug. 26, 1983 [JP] Japan ..... 58-155096

[51] Int. Cl.[4] ..... F02B 3/00; F02D 9/00

[52] U.S. Cl. ..... 123/489; 123/440; 123/478; 123/350; 123/492

[58] Field of Search ..... 123/350, 478, 492, 493, 123/489, 440; 261/51, 50, DIG. 19

[56] References Cited

U.S. PATENT DOCUMENTS

| | | | |
|---|---|---|---|
| 3,771,504 | 11/1973 | Woods | 123/478 |
| 4,113,046 | 9/1978 | Arpino | 123/350 |
| 4,319,658 | 3/1982 | Collonia et al. | 123/350 |
| 4,335,694 | 6/1982 | Mausner et al. | 123/478 |
| 4,353,339 | 10/1982 | Collonia | 123/350 |
| 4,377,995 | 3/1983 | Fiala | 123/478 |
| 4,426,980 | 1/1984 | Eisele et al. | 123/350 |
| 4,442,818 | 4/1984 | Kashiwaya et al. | 123/493 |
| 4,449,508 | 5/1984 | Glockler et al. | 123/492 |
| 4,469,074 | 9/1984 | Takao et al. | 123/492 |
| 4,471,741 | 9/1984 | Asik et al. | 123/478 |
| 4,473,052 | 9/1984 | Kamiyama et al. | 123/478 |
| 4,476,834 | 10/1984 | Nakazato | 123/492 |

*Primary Examiner*—Raymond A. Nelli

*Attorney, Agent, or Firm*—Antonelli, Terry & Wands

[57] ABSTRACT

An engine control apparatus of fuel supply preferential type in which the rate of fuel supply is controlled in accordance with the amount of operation of an accelerator pedal and the operation condition of the engine, and the opening of the throttle valve is controlled in accordance with a command opening which is determined by the rate of the fuel supply is disclosed. For ensuring a good air-fuel ratio control, the control apparatus comprises first closed loop control adapted to detect the throttle valve opening and to effect a control to make the throttle valve opening converge at the command opening and second closed loop control adapted to detect the air-flow ratio of the air-fuel mixture fed to the engine wth air-fuel ratio sensor which detects oxygen concentration in the exhaust gases from the engine and to effect a control to make the air-fuel ratio converge at a command air-fuel ratio.

4 Claims, 20 Drawing Figures

FIG. 14
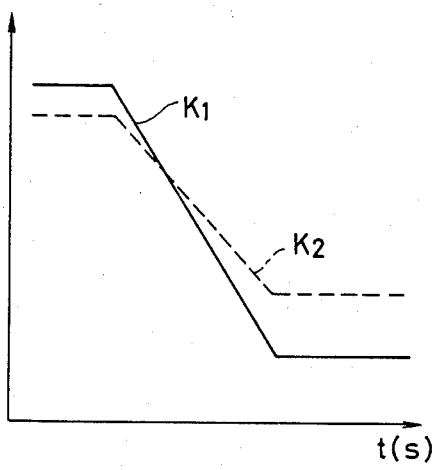
FIG. 15
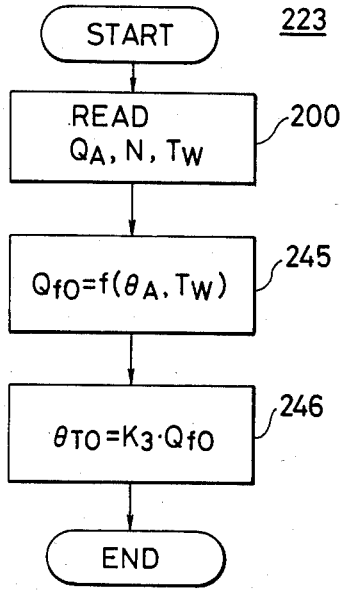
FIG. 16A
FIG. 16B
FIG. 16C
FIG. 16D
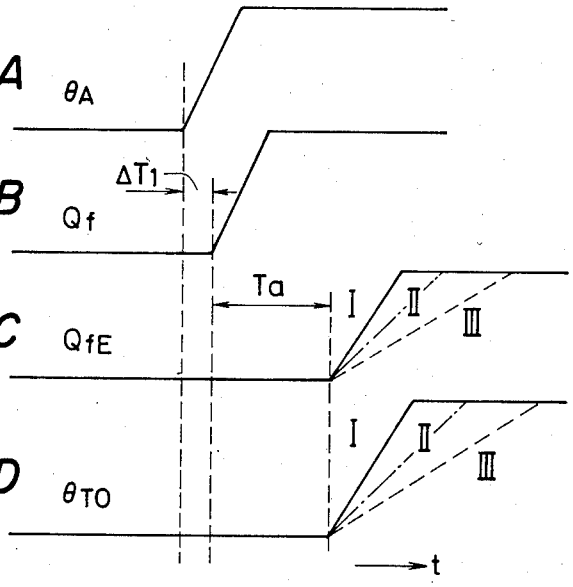

ENGINE CONTROL APPARATUS

BACKGROUND OF THE INVENTION

The present invention relates to an apparatus for controlling an internal combustion engine such as a gasoline engine used for a motor vehicle, and, more particularly, to an apparatus for accurately controlling an air-fuel ratio of an internal combustion engine.

In the operation of an internal combustion engine such as a gasoline engine, it is preferred that the mixing ratio of air and fuel of the air-fuel mixture, i.e., the air-fuel ratio, is maintained exactly at a desired level.

In an ordinary internal combustion engine such as an gasoline engine of a motor vehicle, the intake air flow rate is controlled directly by a throttle valve mechanically connected to an accelerator pedal, and the fuel is metered mechanically by a carburetor or electrically by an electronic fuel injection controller in accordance with the intake air flow rate so as to attain the desired air-fuel ratio.

This conventional method of air-fuel ratio control has the drawback in that the desired air-fuel ratio is not attained, particularly in the transient period of the control because the change in the fuel supply rate cannot follow-up the change in the intake air flow rate due to a difference in the inertia, i.e., the specific gravity, between the air and the fuel such as gasoline. More specifically, the mixture temporarily becomes too lean when the engine is accelerated and too rich when the engine is decelerated, resulting in deviation from the air-fuel ratio aimed for.

The conventional control method explained above may be referred to as "intake air flow rate preferential type" or "follow-up fuel supply rate control type". In order to avoid theres drawbacks, U.S. Pat. No. 3,771,504 proposes a control system which may be referred to as "fuel supply rate preferential control type" or "follow-up intake air flow rate control type".

Under these circumstances, the object of the present invention is to provide an improved control apparatus of the "fuel supply rate preferential control" type for enhancing the control precision and response characteristics of the air-fuel mixture supply system, thereby ensuring a good air-fuel ratio control.

In accordance with advantageous features of the present invention, an engine control apparatus of fuel supply preferential control type is proposed wherein the rate of fuel supply is controlled in accordance with the amount of operation of an acceleration pedal and the operation condition of the engine, and the opening of the throttle valve is controlled in accordance with a command opening which is determined by the rate of the fuel supply, with the control apparatus comprising a first closed loop control means adapted to detect the throttle valve opening and to effect a control to make the throttle valve opening converge at the command opening, and a second closed loop control means adapted to detect the air-fuel ratio of air-fuel mixture fed to the engine by detecting oxygen concentration in exhaust gases from the engine and to effect a control to make the air-fuel ratio converge at a command air-fuel ratio.

The engine control apparatus further includes means for controlling the command opening so that the commencement of the operation for controlling the throttle valve opening is delayed in accordance with the engine conditions, and the changing rate of the command opening is controlled in accordance with the engine conditions at the time of acceleration or deceleraion.

BRIEF DESCRIPTION OF THE DRAWINGS

FIG. 14 is a graphical illustration depicting conditions necessary for setting various coefficients;

FIG. 15 is a flow chart of operation in a warming up mode;

FIGS. 16A, 16B, 16C and 16D are diagrams respectively illustrating the control necessary in the acceleration mode.

DETAILED DESCRIPTION

An embodiment of the engine control apparatus in accordance with the invention will be explained hereinunder with reference to the accompanying drawings.

Figure 1:
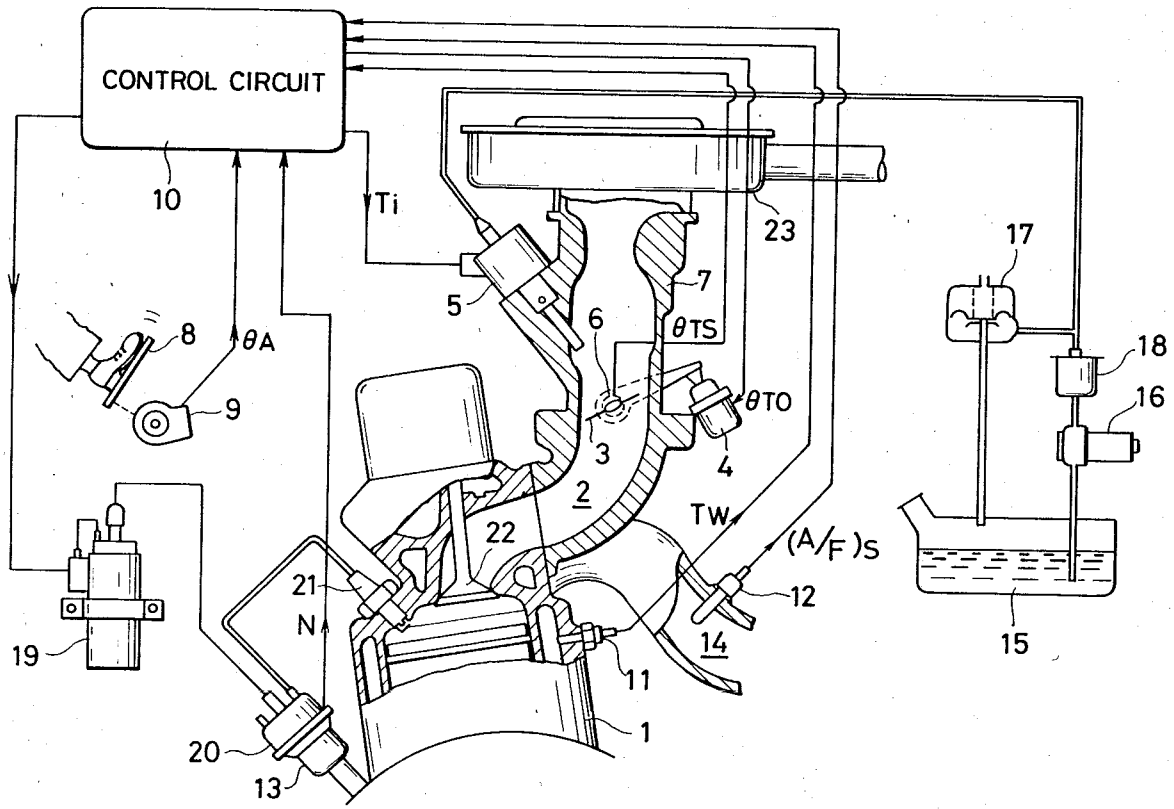
FIG. 1 is a partiall cross-sectional schematic view of an engine control system incorporating an embodiment of the invention.

Referring now to the drawings, wherein like reference numerals are used throughout the various views to designate like parts and, more particularly, to FIG. 1, according to this figure, an embodiment of the engine control apparatus in accordance with the invention includes an internal combustion engine 1, an intake pipe 2, a throttle valve 3, a throttle actuator 4, an fuel injector 5, a throttle opening sensor 6, a throttle chamber 7, an accelerator pedal 8, an accelerator position sensor 9, a control circuit 10, a cooling water temperature sensor 11, an air-fuel ratio sensor 12, speed sensor 13 incorporated in a distributor 20, an exhaust pipe 14, a fuel tank 15, a fuel pump 16 and a fuel pressure regulator 17.

The rate of the intake air drawn into the engine 1 from an air cleaner 22 through the throttle chamber 7, the intake pipe 2 and intake valve 21 is controlled by changing the opening of the throttle valve 3 actuated by the throttle actuator 4.

The fuel is drawn from the fuel tank 15 and is pressurized by the fuel pump 16, with the pressurized fuel being supplied to the injector 5 through a filter 18. The pressure of the pressurized fuel is maintained at a constant level by the pressure regulator 17 and, as the injector 5 is electromagnetically driven by driving signal Ti, the fuel is injected into the throttle chamber 7 by an amount which corresponds to the time duration of the driving signal Ti. The actual opening of the throttle valve 3 is detected by means of the throttle valve opening angle sensor 6 and is inputted to the control circuit 10 as an opening signal $\theta_{TS}$.

When the accelerator pedal 8 is depressed, the position of the accelerator pedal 8 is detected by the accelerator position sensor 9 which, in turn, produces an accelerator position signal $\theta_A$ and delivers the same to the control circuit 10.

After the start-up of the engine 1, the speed of the engine 1 is detected by the speed sensor 13 which produces a speed signal N and delivers the same to the control circuit 10. At the same time, the cooling water temperature sensor 11 produces and delivers an engine temperature signal $T_W$ to the control circuit 10.

As the exhaust gas is introduced into the exhaust pipe 14, the air-fuel ratio sensor 12 produces an air-fuel ratio signal $(A/F)_S$ and delivers the same to the control circuit 10.

The control circuit 10 picks up a position signal $\theta_A$ representing the position of the accelerator pedal 8 from the accelerator position sensor 9 and computes the rate of the fuel supply using the signal $\theta_A$ together with the speed signal N and the temperature signal $T_W$, and produces the driving signal Ti in the form of a pulse having a pulse width corresponding to the rate of fuel supply. The driving signal Ti is supplied to the injector 5 so that the computed amount of fuel is supplied into the throttle chamber 7. At the same time, the control circuit 10 executes a computation for determining the intake air flow rate on the basis of the computed rate of fuel injection, and produces a driving signal $\theta_{TO}$ corresponding to the computed air flow rate. The driving signal $\theta_{TO}$ is delivered to the throttle actuator 4 which, in turn, controls the opening of the throttle valve 3 to the predetermined value. Thus, the fuel supply rate preferential control or the follow-up intake air flow-rate control is accomplished in the same manner as in a conventional system.

However, unlike conventional systems, the engine apparatus of the invention has two independent loops of feedback control in accordance with two signals, namely, the opening signal $\theta_{TS}$, picked up from the throttle opening sensor 6, and the air fuel rate signal $(A/F)_S$ picked up from the air-fuel rate sensor 12, respectively. Two first and second closed loops of feedback control are applied to the opening of the throttle valve 3 through the throttle actuator 4.

On the other hand, an ignition signal is sent from the control circuit to an ignition coil 19, and then a high voltage ignition pulse is sent to ignition plug 21 through the distributor 20.

Figure 2:
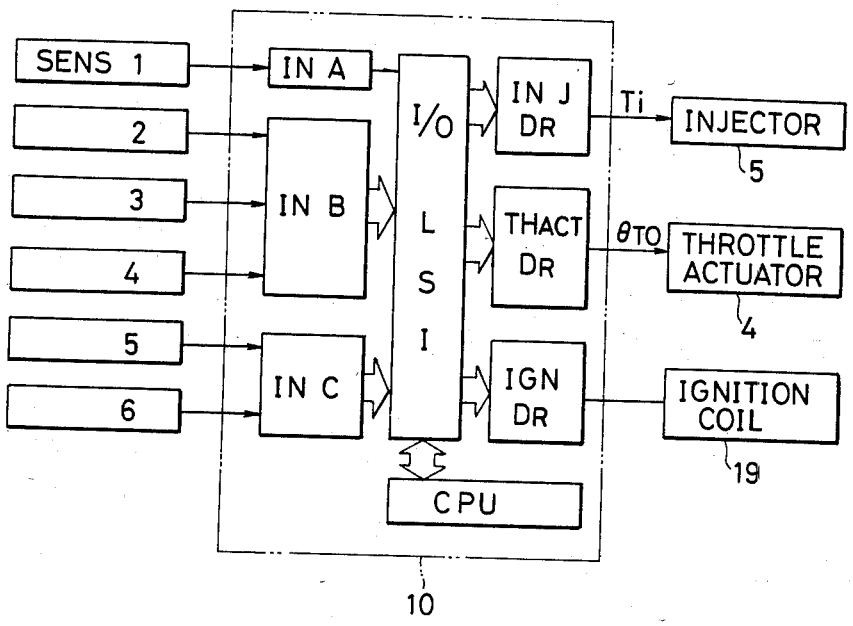
FIG. 2 is a block diagram of an example of a control circuit constructed in accordance with the present invention.

The control circuit 10 FIG. 2, includes a central processing unit CPU which incorporates a microcomputer having a read only memory and a random access memory, an I/O circuit for conducting the input/output processing of the data, input circuits INA, INB and INC having wave-shaping and other functions, and an output circuit DR. In operation, the control circuit 10 picks up signals such as $\theta_{TS}$, $\theta_A$, N, $T_W$, $(A/F)_S$ and so forth through the input ports Sens 1 to Sens 6, and delivers driving signals Ti, $\theta_{TO}$ and other signals to the injector 5, the throttle actuator 4, ignition coil 19 and others through the output circuits DR.

Figure 3:
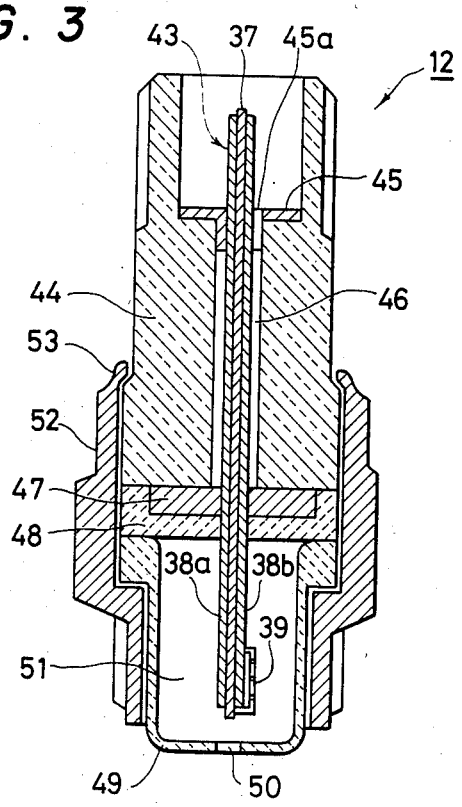
FIG. 3 is a cross sectional view of an air-fuel sensor.

The air-fuel ratio sensor 12 of FIG. 3 includes a sensor unit 43 having electrodes 38*a*, 38*b*, diffusion resistor 39 and a heater (not shown) provided on a solid electrolyte 37. The sensor unit 43 is accommodated in a through hole 46 formed in the center of a ceramics holder 44 and is held by a cap 45 and a stopper 47. The through hole 46 is communicated with the atmosphere through a ventilation hole 45*a* provided in the cap 45. Although not shown in Figure, the stopper 47 is received by a hole provided in the sensor unit 43 and is fitted in the space between the holders 44, 48 thereby fixing the sensor unit 43 to the holders 44 and 48.

The lower end of the sensor unit 43, as viewed in FIG. 3 is positioned in the exhaust gas chamber 51 formed by a protective cover 49, and is communicated with the exterior through a vent hole 50 formed in the cover 49.

The sensor as a whole is assembled by means of a bracket 52 and is finally fixed to a holder 44 by a caulking portion 53, thus completing the assembly.

Figure 4:
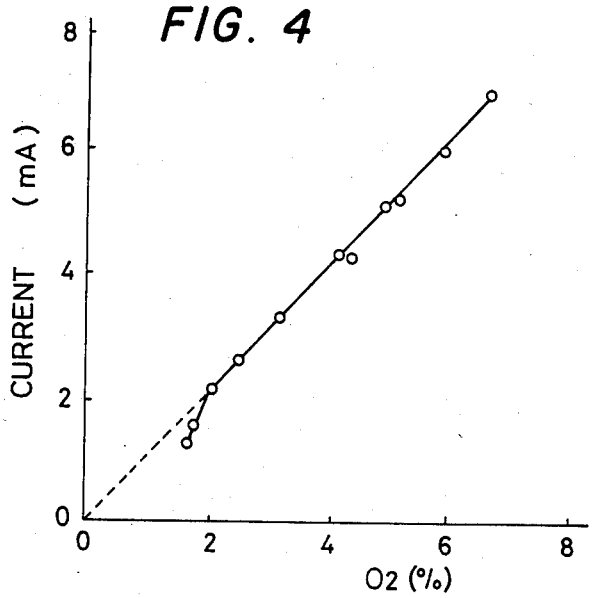
FIG. 4 is a graphical illustration depicting the output characteristics of the air-fuel ratio sensor of FIG. 3.

The air-fuel ratio sensor 12 is mounted in the exhaust pipe 14 of the engine 1 as shown most clearly in FIG. 1, and the exhaust gas from the engine 1 is introduced into the exhaust gas chamber 51 through the vent hole 50, so that the air-fuel ratio sensor 12 produces, as shown most clearly in FIG. 4, a linear output signal substantially proportional to the oxygen concentration in the exhaust gas. Consequently, linear output characteristics can be obtained in the lean region higher than the stoichiometric air-fuel ratio, so that the output of the sensor 12 can be effectively used for the air-fuel ratio control in the lean region.

The throttle actuator 4 may be of a conventional contraction capable of effecting a driving control in response to an electric signal. The throttle valve opening sensor 6 and the accelerator position sensor 9 together function as an encoder the rotational or angular position into electric signals. Thus, this sensor 6 may be fashioned as by a conventional sensor such as a rotary encoder such as, for example, a potentiometer.

Figure 5:
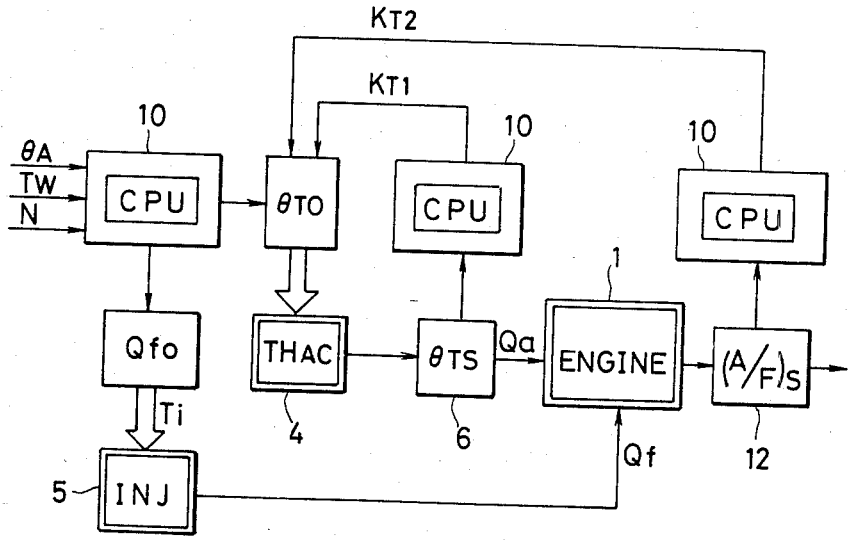
FIG. 5 is a control block diagram for illustrating the operation of an embodiment of the invention.

The above described embodiment operates in the following manner:

Referring to FIG. 5, the microcomputer of the CPU of the control circuit 10 receives the acceleration position signal $\theta_A$, rotation speed signal N and the temperature signal $T_W$, and executes a computation for determining the necessary rate $Q_{fO}$ of fuel supply corresponding to the received signals $\theta_A$, $T_W$, N and delivers a driving signal Ti corresponding to the computed rate of fuel supply to the injector 5.

At the same time, in order that the intake air is supplied at the rate corresponding to the rate $Q_{fO}$ of fuel supply, the control circuit 10 determines the driving signal for the throttle actuator 4, i.e., the throttle valve opening command signal $\theta T_{TO}$ and delivers this signal to the throttle actuator 4.

As a result, the operation of the "fuel supply rate preferential control type" or the "follow-up intake air flow-rate control type" is executed in the manner explained above.

The opening of the throttle valve 3 is thus controlled by the throttle actuator 4 and the opening $\theta$TS is detected by the opening sensor 6. Then, the microcomputer of the control circuit 10 picks up these signals $\theta_{TO}$ and $\theta$TS and determines the difference therebetween as an offset. The microcomputer of the CPU then computes a correction coefficient $K_{T1}$ for nullifying the offset and corrects the signal $\theta_{TO}$ by using this correction coefficient thereby determining a corrected signal $\theta_{TO}'$ by which the throttle actuator 4 is driven. This operation is repeated, i.e., a feedback control is made, to converge the offset between the signal $\theta_{TO}$ and $\theta_{TS}$ to zero, with this feedback control being a "first closed loop system".

The opening of the throttle valve 3 is exactly controlled followed up the command opening by the operation of the first closed loop system. However, this merely ensures that the fuel and the air are fed to the engine 1 at respective aimed supply rates $Q_f$ and $Q_a$, and does not always ensure that the air-fuel ratio A/F.

In view of the above, the following control is conducted by using the output from the air-fuel ratio sensor 12. More particularly, the microcomputer of the CPU of the control circuit 10 picks up the signal $(A/F)_S$ produced by the air-fuel ratio sensor 12, which detects the air-fuel ratio from the exhaust gas flowing in the exhaust gas pipe 14 of the engine 1, and compares this signal $(A/F)_S$ with a command air-fuel ratio data $(A/F)_O$. The microcomputer then conducts a computation to determine the correction coefficient $K_{T2}$ necessary for nullifying the offset and corrects the signal $\theta_{TO}$ utilizing the correction coefficient. The microcomputer then effects the control of the throttle actuator 4 by using, as the new command, the corrected value of the signal $\theta_{TO}$ thereby controlling the flow rate of the intake air by changing the opening of the throttle valve 3. This operation is repeated, i.e., a feedback control is carried out, so as to converge the offset between the signals $(A/F)_O$ and $(A/F)_S$ to zero, with this feedback control being a "second closed feedback system".

Figure 6:
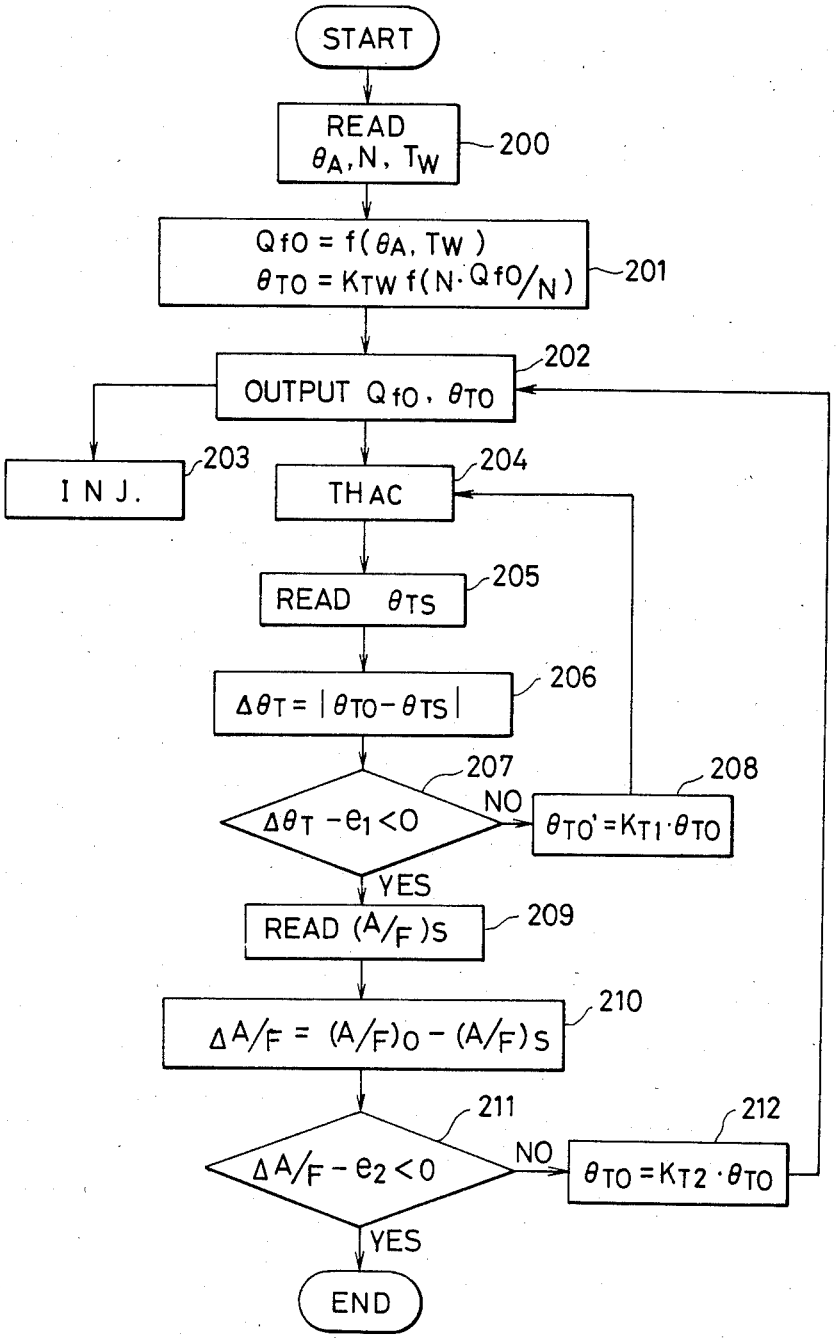
FIG. 6 is a flow chart of the operation of the control blocks in FIG. 5.

As shown most clearly in FIG. 6, the operation of the control blocks of FIG. 5 is repeatedly at such frequency so as to permit the throttle actuator 4 and the injector 5 to be effectively controlled following the operation of the accelerator pedal 8. Upon a commencement of the operation depicted in the flow chart of FIG. 6, the accelerator position $\theta_A$, engine speed N and the engine cooling water temperature $T_W$ are read in step 200.

Then, in step 201, the fuel supply rate signal $Q_{fO}$ for driving the injector 5 and the throttle opening signal $\theta_{TO}$ are computed in accordance with the signals $\theta_A$, N and $T_W$, and the signal $Q_{fO}$ is determined as a function of the signal $\theta_A$ and $T_W$ in accordance with the relationship: $Q_{fO}=f(\theta_A, T_W)$. On the other hand, the signal $\theta_{TO}$ is determined as a predetermined function of the signals $Q_{fO}$ and N as expressed by the relationship: $\theta_{TO}=K_{TW}f(N, Q_{fO}/N)$, and the coefficient $K_{TW}$ is determined. For example, the coefficient $K_{TW}$ for various engine cooling water temperatures $T_W$ is set in and read out of in accordance with the relationship illustrated in FIG. 7.

In step 202, signals $Q_{fO}$ and $\theta_{TO}$ are outputted and the injector 5 is operated by the signal $Q_{fO}$ in step 203. At the same time, the throttle actuator 4 is driven in step 204 by the signals $\theta_{TO}$.

In step 205, the signal $\theta$TS, representing the opening of the throttle valve 3, controlled by the throttle actuator 4, is read by the throttle opening sensor 6, and the offset $\Delta\theta_T$ from the signal $\theta_{TO}$ is determined in the next block 206. Then, in a subsequent block 207, a judgment is made as to whether the offset $\Delta\theta_T$ is greater or lesser than the allowable value $e_1$.

Figure 8:
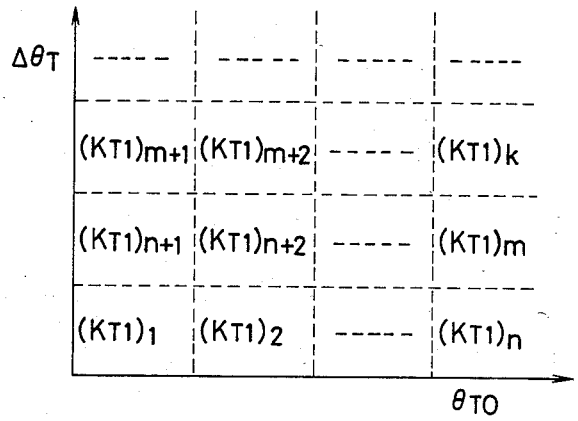
FIGS. 8 and 9 are illustrations of maps used in the setting of the coefficients.

When the result of the computation in the step 207 is NO, i.e., when the offset $\Delta\theta_T$ is greater than the allowable value $e_1$, the process proceeds to step 208 in which a computation is executed in accordance with a formula $\theta_{TO}'=K_{T1}\times\theta_{TO}$ to determine the operation signal $\theta_{TO}'$ for the throttle actuator 4. The coefficient $K_{T1}$ is previously determined as a function of the signal $\theta_{TO}$ and the offset $\Delta\theta_T$, and is stored in the form of a map shown in FIG. 8 and is read out of such a map as required.

The operation of the throttle actuator 4 in step 204 is conducted by using the thus determined signal $\theta$TO', and this operation is repeated until the answer YES is obtained in the judgement conducted in step 207, i.e., until the offset $\Delta\theta_T$ becomes less than the allowable value $e_1$. The operation by the first closed loop system is thus completed.

As a result of the operation of the first closed loop, the offset $\Delta\theta_T$ is gradually converged and comes down below the allowable value $e_1$, so that an answer YES is obtained in step 207. In this case, the process proceeds to step 209, in which the signal $(A/F)_S$ from the air-fuel rate sensor 12 is read. In a subsequent block 210, the offset $\Delta A/F$ between a command air-fuel ratio signal $(A/F)_O$ and the read signal $(A/F)_S$ is determined. Then, in step 211, a judgment is made as to whether the offset $\Delta A/F$ is below the allowable value $e_2$.

Figure 9:
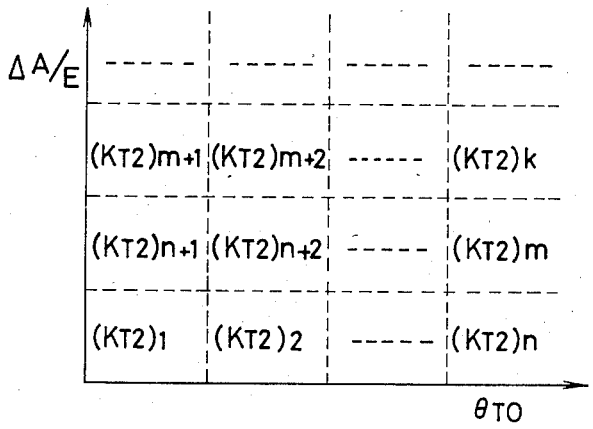

If the answer to the operation in step 211 is NO, i.e., if the offset $\Delta A/F$ is greater than the allowable value $e_2$, the proces proceeds to step 212 and the next signal $\theta_{TO}$ is determined in accordance with a formula of $\theta_{TO}=K_{T2}\times\theta_{TO}$. This signal is returned to step 202 in which the throttle actuator 4 is operated in the direction for reducing the offset $\Delta A/F$. The coefficient $K_{T2}$ is previously computed as a function of the signal $\theta_{TO}$ and the offset $\Delta A/F$, and is stored in the form of the map as shown in FIG. 9 so as to be read out a desired map.

This operation is repeated until the answer to the operation in step 211 is changed to YES, i.e., until the offset $\Delta A/F$ is below the allowable value $e_2$. The operation of the second closed loop system is thus performed. The processing in accordance with this flow is completed when the answer in the step 211 becomes YES.

In the fuel supply rate preferential type control, i.e., the follow-up intake air flow rate type control, the air fuel ratio of the mixture can be controlled at a sufficiently high precision and with satisfactory response characteristics due to the first closed loop system. Additionally, the second closed loop system optimizes the control of air-fuel ratio. Therefore it is, possible to maintain good conditions of the exhaust gas, while ensuring a good feel, driveability or performance of the engine.

Figure 10:
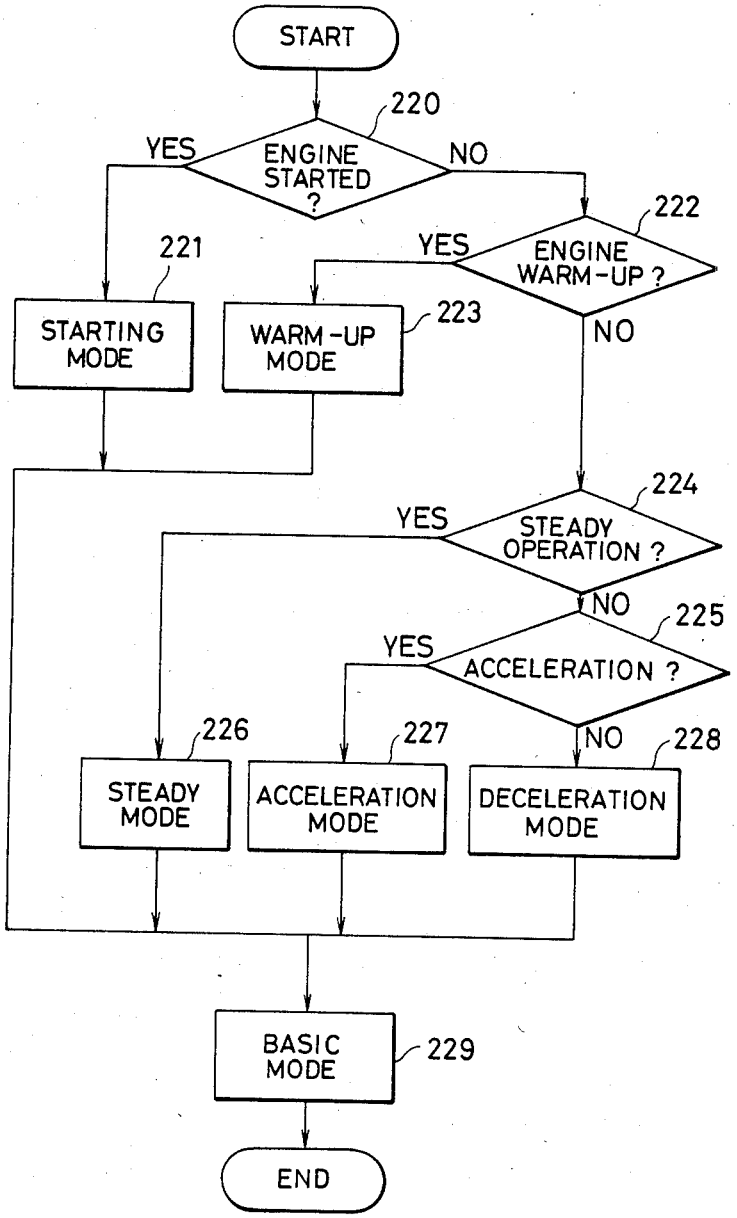
FIG. 10 is a flow chart illustrating the operation of another embodiment of the invention.

As apparent, an engine of a motor vehicle experiences a wide variety of operating conditions, and in, the embodiment of FIG. 10, described hereinunder, optimum control mode is applied in accordance with the operating conditions of the engine to provide a better feel, driveability or performance, as well as and good conditions of the exhaust gases. As shown in FIG. 10, a judgment is made in step 202 as to whether the engine is being started, which can be simply determined by checking whether the ignition key is in starting position.

If an answer of YES is obtained in response to the inquiry in step 220, a control is completed by a starting mode through step 221, followed by a control in accordance with a basic mode in step 229.

If the answer to the inquiry in step 220 is NO, i.e., if the engine is not being started, the process proceeds to step 222 in which a judgment is made as to whether the engine is being warmed up. To this end, the signal $T_W$ from the temperature sensor 11 is examined and the engine is judged as being warmed up when the cooling water temperature of is below a predetermined temperature, for example, below 60° C.

If the result of judgment in step 222 is YES, a control is conducted in accordance with a warming mode in a step 223, followed by the control in step 229.

If the answer to the inquiry in step 222 is NO, i.e., if the engine is judged as being neither in the starting mode nor in the warming up mode, the process proceeds to step 224 in which a judgment is made as to whether the engine is operating steadily. This can be made by examining the output signal $\theta_A$ of the accelerator position sensor 9, and judging whether the rate of change of this signal in relation to time, i.e., the differentiated value of this signal, is below a predetermined level.

In case that the result of judgment in the block 224 is YES, the process proceeds to the block 229 after conducting the control in the steady mode through a block 226.

On the other hand, if result of judgment in the 224 is NO, i.e., when the engine is in none of the conditions of starting, warming up and steady operation, the process proceeds to step 225 in which a judgment is made as to whether the engine is being accelerated. To this end, the output signal $\theta_A$ of the accelerator position sensor 9 is examined and a judgment is made as to whether the symbol attached to the signal is positive.

If the answer to the inquiry in step 225 is YES, the process proceeds for the execution of step 229 after execution of the processing in the acceleration mode through step 227.

On the other hand, if the result of inquiry in the 225 is NO, i.e., if the engine is in none of the operating condition of starting up, warming, steady operation and acceleration, it is judged that the engine is being decelerated, so that the process proceeds for the execution of the basic mode control in step 229 after executing the control of the deceleration mode through the 228.

Figure 11:
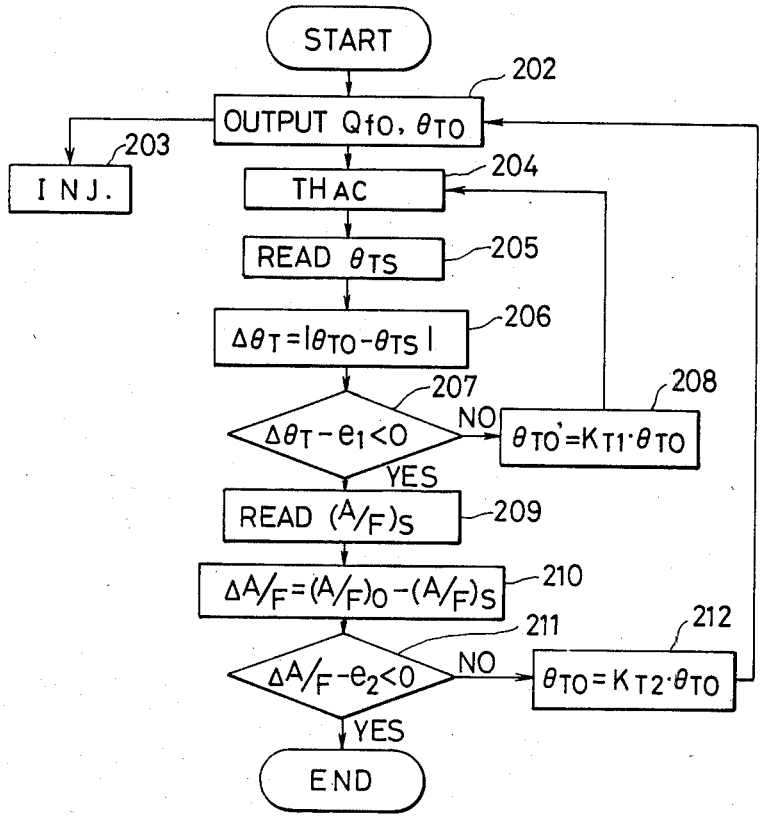
FIG. 11 is a flow chart of operation in a basic mode.

FIG. 11 provides an example of the processing in the basic mode 229 which is commonly executed by all conditions of operation of the engine. As apparent from FIG. 11, the content of the basic mode 229 is identical to that performed in steps 202 through 212 in the embodiment explained above in connection with FIG. 6.

Figure 12:
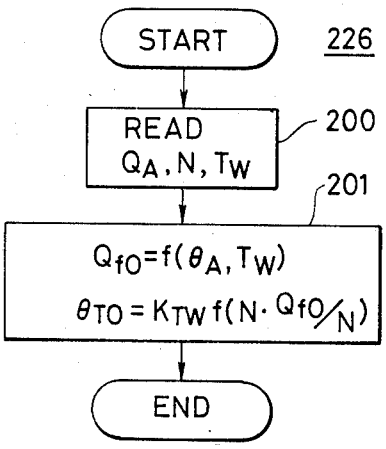
FIG. 12 is a flow chart of operation in a steady mode.

The content of processing of the steady mode 226 is shown by a flow chart in FIG. 12 and is identical to that performed in steps 200 and 201 in the embodiment shown in FIG. 6.

As will be understood from FIGS. 11 and 12, the same operation as that in the embodiment of FIG. 6 is executed also in the embodiment shown in FIG. 10, when the operating mode is a steady operation mode.

Figure 7:
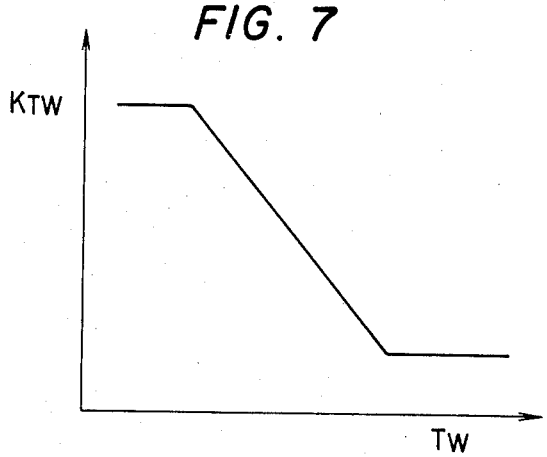
FIG. 7 is a graphical illustration depicting the conditions for setting various coefficients.
Figure 13:
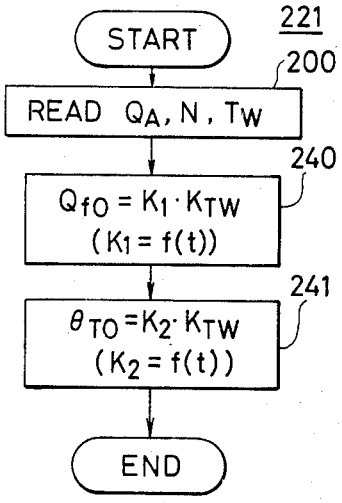
FIG. 13 is a flow chart of operation in a starting mode.

As shown in FIG. 13, as the process of the starting mode 221 is commenced, the reading of signals is conducted in step 200 and signals $Q_{fO}$ and $\theta_{TO}$ are successively computed in the subsequent steps 240 and 241, using the coefficients $K_{TW}$, $K_1$ and $K_2$. The coefficient $K_{TW}$ is previously stored in the form of, for example, a map as a function of the engine temperature as shown in FIG. 7, and is read out from the map as desired. On the other hand, the coefficients $K_1$ and $K_2$ are previously determined as function of the time t and exhibit decreasing tendencies.

Consequently, when the engine is started, the fuel is supplied at a rate exceeding the necessary supply rate, i.e., so-called start-up incremental control is conducted, in the beginning period of the start up of the engine. At the same time, the throttle valve 3 is open to a large degree. For these reasons, the startin up of the engine is facilitated. As the combustion in the engine is stabilized, the fuel supply rate is reduced to a predetermined level so as to a control which minimizes the degradation of the conditions of exhaust gases.

FIG. 15 provides a flow chart for processing in the warminfg up mode 223. After reading the signal in step 222, the signal $Q_{fO}$ and $\theta_{TO}$ are successively computed in steps 245 and 246. In this case, it is possible to effect an incremental control of fuel supply during the warming up, by determining the signal $Q_{fO}$ as a function of the temperature. By so doing, the warming up operation is stabilized and completed in a shorter period of time. If suffices only to change the value of the signal $\theta_{TO}$ in proportion to the rate of fuel supply. Therefore, a predetermined coefficient $K_3$ is set as shown in step 246 and executes the computation for determining the signal $Q_{fO}$ by using the coefficient $K_3$ as the proportional constant.

With regard to acceleration mode 227 and a deceleration mode 228, the factors necessary for this control are depicted in FIG. 16. As a driver of the motor vehicle depresses the accelerator pedal 8 to vary the signal $\theta_A$ in FIG. 16A, the quantity $Q_f$ of fuel injected by the injector 5 per each injection cycle is determined by the relationship between the signal $\theta_A$ and $T_W$. Since the delay $T_1$, due to the time for computing is added, the signal actually changes in accordance with the curve as shown in FIG. 16B.

As a matter of fact, however, a not negligible time $T_a$ is required for the fuel of amount $Q_f$ supplied from the injector 5 to reach the cylinder of the engine 1, as will be obvious from the construction of the engine shown in FIG. 1. Additionally, a change in the time constant is caused due to the fact that a part of the fuel injected into the intake pipe 2 attaches to the surface of the intake pipe 2. Consequently, the amount of fuel $Q_{fE}$ actually drawn into the engine varies in a manner shown in FIG. 16C.

Representing the rate of supply of intake air to the engine by $Q_a$, therefore, this value changes in proportion to the amount of fuel $Q_{fE}$ so that the control is, preferably, in such a manner that a constant ratio is maintained therebetween.

In case of air, the delay due to the inertia, i.e., the delay of transportation of air through the intake air pipe 2, is negligible.

It will be seen that, by controlling the throttle valve opening $\theta_{TO}$ in a manner shown in FIG. 16D, the flow rate of the intake air $Q_a$ can be changed exactly following up the change in the fuel supply rate $Q_{fE}$ shown in FIG. 16C.

The attaching of the fuel to the surface of the intake pipe 2 causes a change in the time constant as shown by curves I, II and III in FIG. 16C in accordance with the temperature of the inner surface of the intake pipe 2, i.e., the engine cooling water temperature $T_W$. More specifically, the higher the temperature $T_W$ becomes, the smaller becomes the influence due to the attaching of fuel, so that the changing characteristics are changed from the curve I to II and then III as the temperature $T_W$ increases.

It is, therefore, necessary that the throttle valve opening $\theta_{TO}$ follows the change in the temperature $T_W$. It is known also that the delay $T_a$ of the air flow rate in substantially determined as the function of the air flow rate $Q_a$.

In view of the above, the following control is required in the acceleration mode. Namely, the signal $Q_{fO}$ is determined in the same manner as the steady mode 226. As to the signal $\theta_{TO}$, the determination is made in accordance with the following formulae.

$$d\theta_{TO}/dt=f(d\theta_A/dt, T_W) \quad (1)$$

$$T_a=f(\theta_{TO}, N) \quad (2)$$

Figure 17:
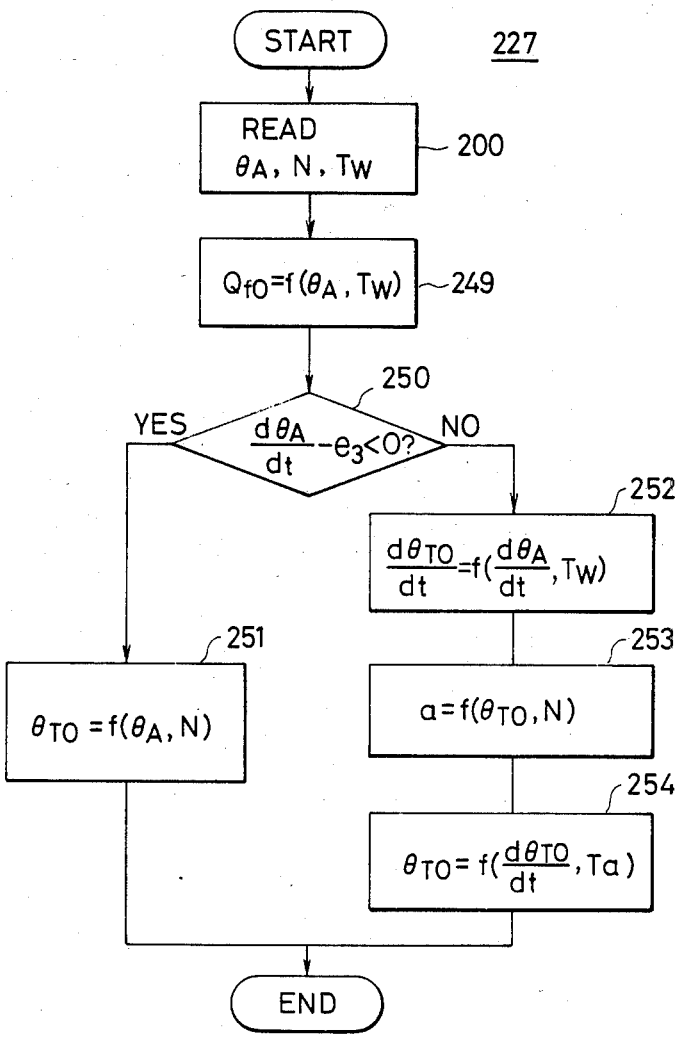
FIG. 17 is a flow chart of operation in an acceleration mode.

Therefore, the processing in the acceleration mode is conducted in accordance with the flow chart in FIG. 17. Namely, as this process is commenced, the pick-up of the necessary signals and the computation of the signal $Q_{fO}$ are conducted in steps 200 and 249. In a subsequent step 250, the rate of acceleration, i.e., the rate of depression of the accelerator pedal 8 is discriminated by the differentiation value of the signal $\theta_A$. If the value is less than a predetermined value $e_3$, the process proceeds to step 251 in which the signal $\theta_{TO}$ is determined by the signals $\theta_A$ and N. In this case, the operation is same as that in the steady mode 226.

On the other hand, when the result of the judgment in step 250 is NO, i.e., when it is judged that the rate of acceleration is greater than a predetermined value given by $e_3$, the process proceeds through steps 252, 253 and 254. In step 252, the computation of the formula (1) is executed, while the computation of the formula (2) is executed in step 153. Consequently, the rate of opening $\theta_{TO}$/dt of the throttle value 3 is determined and a judgment is made as to which one of the curves I, II and III shown in FIG. 16D is to be adopted. Then, the delay time $T_a$ is determined and finally the signal $\theta_{TO}$ is determined in step 254, thereby effecting a control in the manner shown in FIG. 16D.

Referring now to the deceleration mode 228, this mode is different from the above-mentioned mode in that the absolute value of the delay time $T_a$ of the transportation in the intake pipe 2, as well as the absolute values of amounts of change in the time constants shown by the curves I, II and III, is changed, and that the symbol of the signal $d\theta_A$/dt is opposite to that in the acceleration mode. Other points of processing are materially identical to those of the acceleration mode explained before in connection with FIG. 17.

Thus, according to the embodiment of FIGS. 10 and 17, the air-fuel ratio can be minutely controlled in accordance with the conditions of operation of the engine. In fact, during the acceleration and deceleration, a control is effected even on the actual air-fuel ratio of the mixture supplied to the engine, so that the user can enjoy further improved driveability and exhaust gas conditions.

Although, in the described embodiment, the injector 5 is disposed at the upstream side of the throttle valve 3, it is also possible to dispose the injector 5 at the downstream side of the throttle valve 3, as well as multicylinder engines having independent injectors 5 disposed in a vicinity of suction ports of the respective cylinders.

As will be fully realized from the foregoing description, the invention provides an engine control apparatus which is capable of conducting a highly accurate control of the air-fuel ratio of the air-fuel mixture with good response in the "fuel supply rate preferential type control" or "follow-up air flow-rate type control" mode.

What is claimed is:

1. In an engine control apparatus including means for controlling a rate of fuel supplied to an engine, means for controlling a rate of intake air drawn into the engine by changing an opening of a throttle valve actuated by a throttle actuator, an acceleration pedal position sensor means for detecting a position of an acceleration pedal operated by an operator and providing an output signal of the position of the acceleration pedal, further sensor means for detecting engine conditions and providing output signals of sensed engine conditions, said further sensor means including an engine temperature sensor and an engine rotational speed sensor, and a control circuit means for inputting output signals from said acceleration pedal position sensor means and said further sensor means for producing control signals for determining a rate of fuel supply in accordance with a position of said acceleration pedal, the engine conditions, and an opening of said throttle valve is controlled in accordance with a command opening determined in accordance with the rate of the fuel supply, the control apparatus comprising:

first closed loop control means for detecting the throttle valve opening and for effecting a control to make the throttle valve opening converge at said command opening, said first closed loop control means including a throttle opening sensor means for detecting an opening of said throttle valve, said control circuit means, and said throttle actuator, and second closed loop control means for detecting the air-fuel ratio of the air-fuel mixture supplied to the engine and for effecting a control to make the air-fuel ratio converge at a command air-fuel ratio, said second closed loop means including an air-fuel ratio sensor means for detecting oxygen concentration in exhaust gas of the engine, said control circuit means, and said throttle actuator.

2. The engine control apparatus according to claim 1, wherein said air-fuel ratio means has a linear output characteristics.

3. The engine control apparatus according to claim 1, further comprising means for controlling said command opening in such a manner that a commencement of an operation for controlling the throttle valve opening is delayed in accordance with the engine conditions during at least one of an acceleration or deceleration of the engine.

4. The engine control apparatus according to claim 1, further comprising means for controlling said command opening in such a manner that a commencement of the operation for controlling the throttle valve opening is delayed in accordance with the engine conditions and a changing rate of said command signal is controlled in accordance with the engine conditions during at least one of an acceleration or deceleration of the engine.

* * * * *